US007131679B1

(12) United States Patent
Teran

(10) Patent No.: US 7,131,679 B1
(45) Date of Patent: Nov. 7, 2006

(54) COMBINATION SLING AND FIRE EXTINGUISHER

(76) Inventor: Jerry V. Teran, 4201 Estate Dr., Corpus Christi, TX (US) 78412

( * ) Notice: Subject to any disclaimer, the term of this patent is extended or adjusted under 35 U.S.C. 154(b) by 0 days.

(21) Appl. No.: 11/116,632

(22) Filed: Apr. 29, 2005

(51) Int. Cl.
*B66C 1/12* (2006.01)

(52) U.S. Cl. ..... 294/77; 294/151; 169/30

(58) Field of Classification Search ..... 294/74–77, 294/149–152, 157; 224/148.5, 148.6, 651; 47/67; 248/317, 318; 215/395, 399; 383/12, 383/16, 104, 121.1; 169/30
See application file for complete search history.

(56) References Cited

U.S. PATENT DOCUMENTS 1,208,728 A * 12/1916 Bartlett et al. ..... 224/148.6
1,308,263 A * 7/1919 Smith ..... 383/16
1,457,304 A * 6/1923 Hodcson ..... 294/77
2,440,712 A 5/1948 Bickell
2,464,069 A * 3/1949 Benson ..... 206/466
3,116,948 A 1/1964 Elsner
3,351,371 A 11/1967 Headrick
3,765,711 A * 10/1973 Hammond ..... 294/77
3,870,358 A 3/1975 Bennett
4,976,383 A * 12/1990 Norris ..... 224/640
5,641,189 A * 6/1997 Landman ..... 294/77
5,645,129 A 7/1997 Renna
5,816,331 A 10/1998 Vivier
5,918,785 A * 7/1999 Irose ..... 224/259

* cited by examiner

*Primary Examiner*—Dean J. Kramer
(74) *Attorney, Agent, or Firm*—G Turner Moller

(57) ABSTRACT

A sling for a fire extinguisher or other tubular equipment comprises a generally tubular body made of bodily flexible webbing crossing at connected intersections. The bottom of the tubular body is made of the webbing intersecting at, and radiating from, a common point. The tubular body provides a plurality of looped ends for attachment to a hoist line. A resilient rubber plate rests on the bottom of the tubular body and provides a cushion for the fire extinguisher and prevents the webbing from spreading to an extent where the fire extinguisher might fall through.

8 Claims, 1 Drawing Sheet

COMBINATION SLING AND FIRE EXTINGUISHER

BACKGROUND OF THE INVENTION

During major maintenance operations at refineries and chemical plants, it is often necessary for workers to enter and work inside tall generally cylindrical structures, known as vessels. These vessels typically are reactor vessels such as catalytic crackers, separation vessels such as crude units and the like. Because there is a substantial fire hazard inside the vessels, it has become common practice to provide a worker, called a fire watch, whose responsibility is keeping a lookout for fires and providing a first response in the event of a fire. The fire watch is equipped with an industrial sized fire extinguisher which must be delivered to the location where work is being conducted.

Because these type vessels are often quite tall, equipment such as industrial sized fire extinguishers are typically delivered by the hoist line of a crane or winch unit. In the past, a fire extinguisher was simply tied to a flexible line and hoisted to its desired location. Because a fire extinguisher has no obvious connections for a hoist line and because the workers on the ground tying the hoist line to the fire extinguisher have little or no experience in this exact problem, it is little wonder that fire extinguishers are periodically dropped during the hoisting operation. One can imagine the dangers in dropping a 50–100 pound load from great heights.

Disclosures of some interest relative to this invention are found in U.S. Pat. Nos. 2,440,712; 3,116,948; 3,351,371; 3,870,358; 5,645,129 and 5,816,331.

SUMMARY OF THE INVENTION

In this invention, a sling is made of bodily flexible webbing, preferably of a woven material, of suitable strength to accommodate the load of an industrial sized fire extinguisher which is typically on the order of 50–100 pounds. The sling is more-or-less tubular to accommodate the conventional tubular tank of a fire extinguisher. The bottom of the sling is reinforced with a separate structural member, which is preferably a resilient planar rubber member or plate. Sections of the webbing extend upwardly from the open top of the tubular sling and are looped to easily connect to a hoist line.

Because the webbing is of bodily flexible material, a fire extinguisher may be placed in the sling without occupying any appreciable greater volume. This allows the fire extinguishers to be stowed in the sling, meaning that it provides a convenient package so the slings do not have to be found when a major maintenance operation is approaching.

It is an object of this invention to provide an improved sling for hoisting a fire extinguisher or other tubular equipment to an elevated location.

A further object of this invention is to provide an improved sling-fire extinguisher package for hoisting the fire extinguisher to an elevated location.

A more specific object of this invention is to provide an improved sling, made of fabric webbing and a resilient bottom structure, for hoisting a fire extinguisher or other tubular equipment.

These and other objects and advantages of this invention will become more apparent as this description proceeds, reference being made to the accompanying drawings and appended claims.

DETAILED DESCRIPTION

Figure 3:
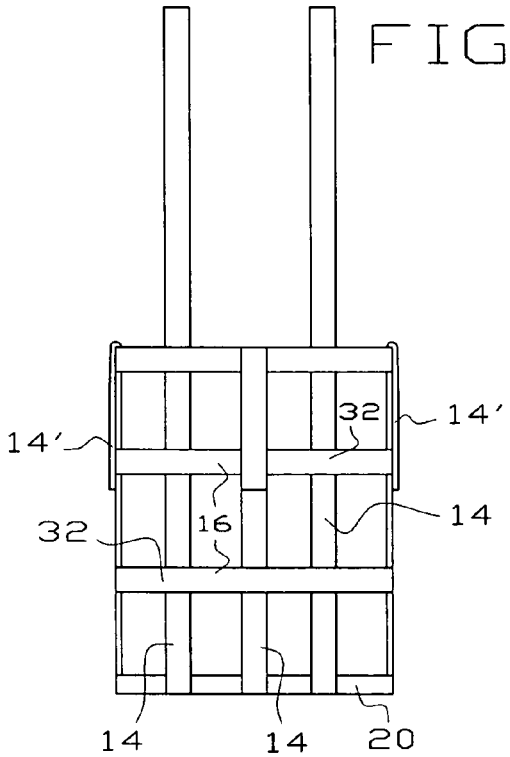
FIG. 3 is a side view of the sling of FIG. 1.
Figure 4:
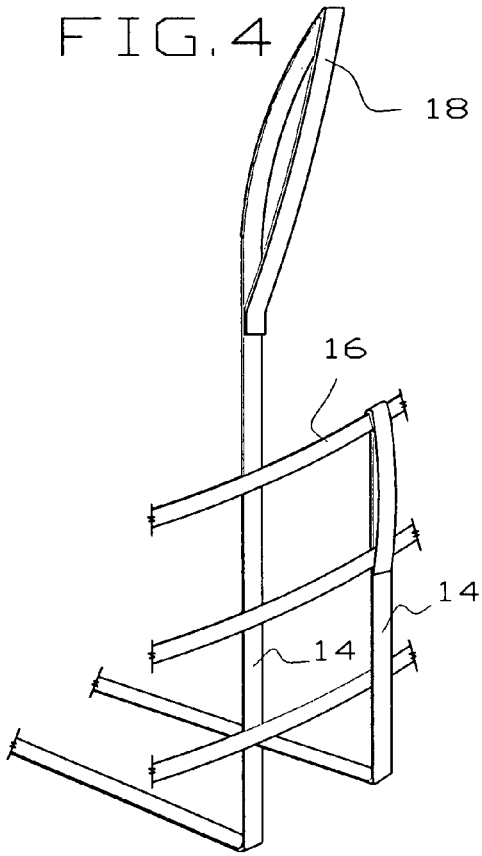
FIG. 4 is an enlarged sectional view of the sling of FIG. 1, illustrating one webbing member providing a looped end and an adjacent webbing member doubled over.

Referring to FIGS. 1–4, there is illustrated a sling 10 of this invention comprising, as major components, a tubular body 12 of webbing 14, 14', 16 having a series of looped ends 18 and a structural bottom 20. A fire extinguisher or other tubular equipment 22 is placed in the sling 10 and may be hoisted or Q lowered by attaching a hoist implement (not shown) through the looped ends 18. The fire extinguisher is illustrated as being of a conventional type having a container receiving a fire extinguishing material and a valve for selectively dispensing the material.

Figure 2:
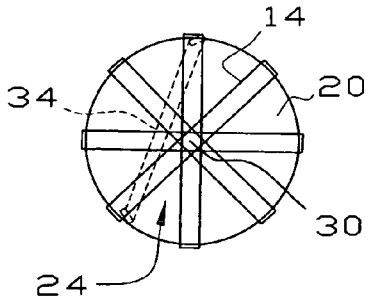
FIG. 2 is a bottom view of FIG. 1.

The tubular body 12 provides a closed bottom 24, a generally cylindrical section 26 and an open top 28. The bottom 24 of the sling 10 is fabricated by orienting the webbing 14, 14' at various angles about a common point 30 as shown in FIG. 2 and then securing the webbing together at the common point, either by use of adhesives or preferably by sewing. The webbing 14, 14' extends away from the bottom 24 to align in a more-or-less cylindrical manner to form the cylindrical section 26. Webbing 16 of similar material are then wound circumferentially at suitable spaced intervals on the webbing 14, 14' and the intersections 32 are connected together, either by adhesives or by sewing. As shown best in FIG. 4, the webbing 14 is inward of the webbing 16 to prevent the fire extinguisher 22 from snagging the upper edge of the webbing 16 when it slides or otherwise moves into the tubular sling 10.

The looped ends 18 comprise the ends of the webbing 14 which are looped and then sewn or otherwise attached to themselves. Each of the webbing 14' is looped over the uppermost webbing 16 and attached to itself at a location in the cylindrical section 26. There are at least two looped ends 18 and preferably more to provide stability, i.e. prevent the fire extinguisher 22 from sliding out of the sling 10 during hoisting.

The webbing 14, 14', 16 may be of any suitable type and strength and is conveniently a doubled nylon web having a tensile strength of at least two hundred pounds.

The structural bottom 20 is preferably of circular shape to support the fire extinguisher 22 and also to prevent the webbing 14, 14' from spreading to the extent that the fire extinguisher 22 may fall between adjacent ones of the webbing 14, 14'. The bottom 20 is preferably made of a rubber or rubber-like material providing a cushion for the fire extinguisher 22 in the event the sling 10 is dropped.

Figure 1:
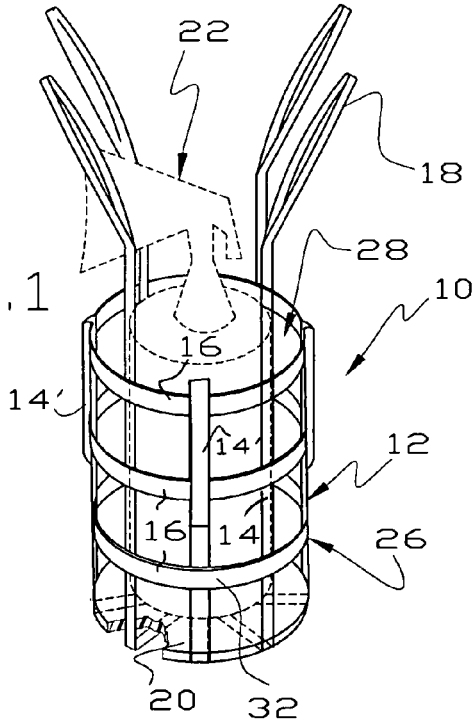
FIG. 1 is an isometric view of a sling and fire extinguisher of this invention.

Although the structural bottom 20 is shown in FIG. 1 to preferably simply lie in the bottom of the sling 10, it may be captivated therein, as by the provision of a separate webbing member 34, spaced from and spanning the closed bottom 24 as shown in dashed lines in FIG. 2. The webbing member 34 may be secured to the webbing 14, 14' in any suitable manner, as by adhesives or sewing.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A combination sling and fire extinguisher wherein the fire extinguisher comprises a tubular exterior and a bottom, the sling comprising a closed bottom, open top tubular body of bodily flexible webbing crossing at connected intersections, at least two looped extensions extending upwardly from the open top for securement to a hoist line and a structural bottom wall, independent of the closed bottom, received in the tubular body for supporting the fire extinguisher and preventing the webbing on the bottom from spreading, the structural bottom being loosely received in the tubular body adjacent the closed bottom, the fire extinguisher bottom abutting and being supported directly on the structural bottom and there being no solid material between the exterior of the fire extinguisher and the flexible webbing of the tubular body.

2. The sling of claim 1 wherein the webbing comprises woven fabric webbing sewn together at the intersections.

3. The sling of claim 1 wherein the closed bottom comprises the webbing extending across the closed bottom.

4. The sling of claim 3 wherein the webbing extending across the closed bottom comprises a multiplicity of webbing sections radially extending away from a common point.

5. The sling of claim 3 wherein the webbing extending across the closed bottom includes webbing sections extending upwardly along the sides of the tubular body and the tubular body further comprises bodily flexible webbing strips extending circumferentially around the tubular body and intersecting the upwardly extending webbing sections at connected intersections, the upwardly extending webbing sections being inward of the circumferential webbing strips.

6. The sling of claim 5 wherein the looped extensions comprise extensions of at least some of the webbing sections extending upwardly along the sides of the tubular body.

7. The sling of claim 1 wherein the structural bottom wall is resilient.

8. The sling of claim 7 wherein the structural bottom wall is a planar plate of rubber material.

* * * * *